US007408436B2

(12) United States Patent
Ikezawa

(10) Patent No.: US 7,408,436 B2
(45) Date of Patent: Aug. 5, 2008

(54) COIL AND BOBBIN FOR COIL

(75) Inventor: Akira Ikezawa, Chuo-ku (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/587,742

(22) PCT Filed: Jan. 27, 2005

(86) PCT No.: PCT/JP2005/001054

§ 371 (c)(1),
(2), (4) Date: Jul. 28, 2006

(87) PCT Pub. No.: WO2005/073991

PCT Pub. Date: Aug. 11, 2005

(65) Prior Publication Data

US 2007/0171023 A1 Jul. 26, 2007

(30) Foreign Application Priority Data

Jan. 30, 2004 (JP) ..... 2004-024319

(51) Int. Cl.
*H01F 27/30* (2006.01)

(52) U.S. Cl. ..... 336/208; 336/212; 336/198

(58) Field of Classification Search ..... 336/212, 336/208, 198, 192, 108, 182, 200, 180
See application file for complete search history.

(56) References Cited

U.S. PATENT DOCUMENTS 6,002,319 A * 12/1999 Honma ..... 336/73
6,222,437 B1 4/2001 Soto et al.
6,639,501 B2 * 10/2003 Wang et al. ..... 336/208
6,972,657 B1 * 12/2005 Pacala et al. ..... 336/200
2004/0004071 A1 * 1/2004 Ogasawara et al. ..... 219/619

FOREIGN PATENT DOCUMENTS

| | | |
|---|---|---|
| JP | 52 22550 | 2/1977 |
| JP | 6 21230 | 3/1994 |
| JP | 6 151207 | 5/1994 |
| JP | 2000 164430 | 6/2000 |
| JP | 2002 246240 | 8/2002 |

OTHER PUBLICATIONS

English Translation of Japanese Office Action of PCT Application No. 2004--024319, dated Mar. 31, 2004.

* cited by examiner

*Primary Examiner*—Anh T Mai
(74) *Attorney, Agent, or Firm*—Oblon, Spivak, McClelland, Maier & Neustadt, P.C.

(57) ABSTRACT

A bobbin has a bobbin body capable of fitting into the inside of a winding, and a protrusion protruding from the outer peripheral surface of the bobbin body and capable of intervening between windings. Preferably, stopper means is further provided for preventing the bobbin from rotating. This means is a stopper piece which protrudes from the outer peripheral surface of the bobbin body substantially on the opposite side of the protrusion, and fits in a slit formed at a bend of the winding. The stopper means may have a flange extending from one end of the bobbin body, and a stopper protrusion protruding from a flange edge in a direction opposite to a direction in which the bobbin body extends, for engagement with a core. The protrusion may have a thickness dimension equal to or larger than a spacing between windings.

20 Claims, 10 Drawing Sheets

COIL AND BOBBIN FOR COIL

TECHNICAL FIELD

The present invention relates to a coil and a bobbin for a coil, and more particularly, to a structure of a bobbin for a coil which is suitable for use in a DC-DC converter, a transformer and the like mounted in a car.

BACKGROUND ART

It is often the case that an internal combustion engine car, an electric car, or a hybrid car, which employs a combination of an internal combustion engine and a motor, require a plurality of supply voltages.

For example, the electric car and hybrid car are generally equipped with a high-voltage battery for driving a motor for running at high voltages, and simultaneously equipped with a low-voltage battery (for example, 12-volt based) for powering a variety of electrical components because their parts are used in common with the internal combustion engine car. Also, in the internal combustion engine car, higher voltages are more advantageous for EPS (electric power steering), defogger (hot wires on a rear wind shield) and the like, whereas low voltages (for example, 5V, 3.3V) are dominating in an in-vehicle control/communication system such as an ECU (electronic control unit). Further, for responding to increasingly higher requests for electric power in the feature, there have been also provided some cars which are equipped with a high-voltage battery (for example, 36 V or 42 V), and a low-voltage battery (12 V) which supports a rated voltage of existing electrical components.

Then, in a car which has these two types of high and low powering systems, a DC voltage is scaled up and down by a DC-DC converter arranged between a low-voltage battery and a high-voltage battery to distribute power within the car. Also, even in a car equipped with a single battery, a voltage supplied from the battery is often scaled up and down by a DC-DC converter to efficiently accommodate a request for a plurality of types of voltages.

Such a DC-DC converter generally comprises respective elements such as a transformer, a diode, a capacitor, a switching element and the like. As a coil for a transformer, widely used is one having a winding which is formed by spirally bending an elongated plate-shaped conductive material (sheet metal) or by folding a sheet metal.

FIG. 15 illustrates an exemplary coil which is used in a DC-DC converter. As illustrated in FIG. 15, this coil 100 comprises a winding 2 formed of a sheet plate spirally bent to have a plurality of loop patterns, cores 4*a*, 4*b* which cover the winding 2 from above and below, and bobbins 1*a*, 1*b* disposed between the winding 2 and cores 4*a*, 4*b* to provide isolation therebetween.

Also, there is U.S. Pat. No. 6,222,437 which discloses a coil which has a winding formed by folding a sheet plate.

DISCLOSURE OF THE INVENTION

However, in the above-mentioned coil which has the winding formed of a sheet plate, the isolation is established between the winding and cores by disposing the bobbins therebetween, but isolation between windings relies only on spaces formed by opening spacings between the windings.

As such, when a vehicle such as a car is equipped with an electrical component including such a coil, the coil itself is likely to mechanically resonate due to vibrations of an engine and swinging during running, so that windings are likely to come into contact with one another to result in a short-circuit. Particularly, the spacing between windings cannot be sufficiently ensured in a coil which is reduced in thickness by responding to requests for a reduction in size of electrical components in recent years. Accordingly, the conventional coil structure experiences difficulties in ensuring a sufficient reliability in regard to insulation between windings.

On the other hand, it is also contemplated that insulation processing is performed by coating a resin on the surface of windings, instead of relying only on the gap between windings. However, such a structure causes an increase in manufacturing steps of the coil, a higher manufacturing cost, and a rise in unit price of parts. Also, even if an insulating coating is formed, the insulating coating will be damaged or deteriorated if windings repeatedly collide each other during a long-term use, so that the short-circuit cannot be completely prevented.

Therefore, a problem that the invention is to solve is insufficient insulation between windings of a coil, and it is an object of the present invention to solve this problem to enhance the reliability of the coil.

To solve the above problem, a bobbin for a coil according to the present invention has a bobbin body formed of an insulating material, and capable of fitting into the inside of a winding of a coil, and a protrusion formed of an insulating material, extending outward from an outer peripheral surface of the bobbin body, and capable of interposing between windings.

In the bobbin of the present invention having the configuration as described, when the bobbin is mounted in a coil by fitting the bobbin body into the inside of the coil winding, the protrusion formed of an insulating material intervenes between the windings, so that this protrusion prevents the windings from coming into contact with each other. Therefore, even if vibrations are applied to the coil, as is the case where it is mounted, for example, in a car, the windings of the coil can be prevented from coming into contact with each other to cause a short-circuit accident, thus improving the reliability of the coil.

Though not so limited, the bobbin of the present invention is suitable for use in a so-called folded coil which has a plurality of loops formed by folding up a sheet plate. In such a folded coil, a bend is generally formed at one end of the coil (loops), and a winding section on the opposite side of the bend (hereinafter, called the "loop leading end") is supported by the bend in a cantilever manner, so that the loop leading end is susceptible to vibrations. Therefore, when the bobbin of the present invention is mounted in a coil, the bobbin body is desirably fitted in the winding such that the protrusion is positioned at the loop leading end.

A number of the protrusions are desirably provided to correspond to at least the number of windings of the coil (number of gaps between the windings). Thus, the bobbin may comprise two or more protrusions, wherein the two or more protrusions may be spaced apart from each other by a predefined spacing corresponding to a pitch of the windings (the spacing of a plurality of gaps formed by adjoining windings of the coil) in a lengthwise direction of the bobbin body.

According to such a bobbin, it can be applied to a coil having three or more turns to prevent the respective windings from coming into contact. Also, when the bobbin is adapted for use in a folded coil, such two or more protrusions are spaced by a predefined spacing in regard to the circumferential direction of the bobbin body, i.e., by a spacing (angle) corresponding to a spacing (angle) between slits formed at the bend of the windings. Due to the structure of the folded coil, the bends of the windings must be shifted in a circumferential direction (or the horizontal direction) of the coil in their formation, so that slits are formed at the winding bends to traverse the coil (winding loops). The slits differ in position from one another in regard to the circumferential direction of the coil, associated with the shift of the bends. Accordingly, the protrusions are positioned corresponding to the shifts in position of the slits, allowing the bobbin to be mounted in the coil.

Also, in the bobbin described above, the bobbin may be provided with stopper means protruding from the bobbin body, and abutting to the winding or core when the bobbin is mounted in the coil to prevent the bobbin from rotating.

This is intended to prevent the bobbin from rotating, causing the protrusions to shift in position, when the coil receives vibrations, for example, as is the case where it is mounted in a car.

As a specific configuration, the stopper means can comprise, for example, a stopper piece which is arranged to protrude outward from the outer peripheral surface of the bobbin body substantially on the opposite side of the protrusion, and fits in a slit formed at a bend of a coil winding.

Alternatively, the stopper means may have a flange extending outward from the outer peripheral surface of the bobbin body at an end of the bobbin body in a lengthwise direction, and at least one stopper protrusion protruding from an edge of the flange in a direction opposite to a direction in which the bobbin body extend for engagement to a core.

Further, the protrusion may have a thickness dimension which is set to a size equal to or larger than a spacing between the windings, in which case the bobbin can be prevented from making rotational shifts in a similar manner to the aforementioned stopper means by press fitting the protrusion between the windings.

Also, a coil according to the present invention comprises any of the bobbins described above, and the coil may have a core.

Further, the bobbin and coil according to the present invention can form part of a transformer, and a DC-DC converter. In the transformer and DC-DC converter, the bobbin of the present invention is mounted in at least one winding of a primary winding and a secondary winding.

Also, an electronic component and an electronic component for a vehicle according to the present invention include the coil according to the present invention.

The vehicle, referred to in the present invention, is not limited to a car, but broadly includes a variety of movable bodies such as a two-wheeled vehicle, a three-wheeled vehicle, a railway vehicle, aircraft, shipping and the like. In addition, as to the car, a track and a bus, and special vehicles such as a construction vehicle and a military vehicle, and the like are included other than a passenger car. Further, the bobbin, coil, or electronic part according to the present invention are suitable for use in a variety of apparatus, machines, and equipment (for example, a variety of portable apparatuses, machine tools, construction machines and the like, which are assumed to be carried) which are supposed to expose to vibrations and swinging, other than vehicles.

According to the present invention, the insulation between windings can be made more reliable to enhance the reliability of the coil.

Other objects, features, and advantages of the present invention will be apparent from the following description of embodiments of the present invention.

BEST MODE FOR CARRYING OUT THE INVENTION

In the following, embodiments of the present invention will be described with reference to FIGS. 1 to 14 of the accompanying drawings.

Embodiment 1

Figure 1:
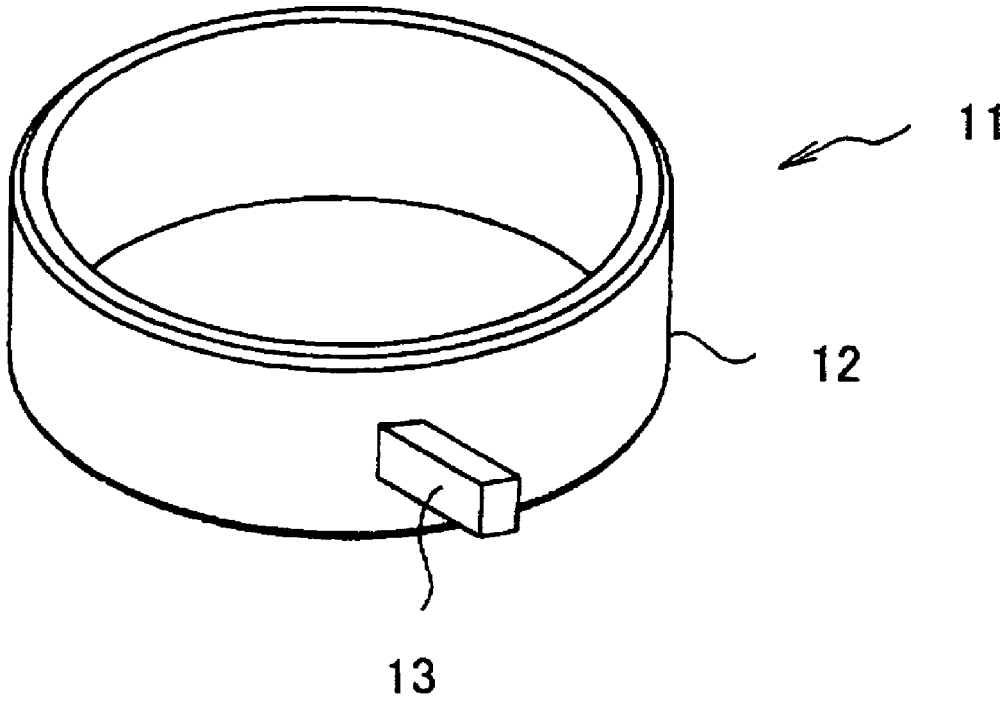
FIG. 1 A perspective view illustrating a bobbin for a coil according to a first embodiment of the present invention.

FIG. 1 illustrates a bobbin for a coil according to a first embodiment of the present invention. A bobbin 11 is formed with a spacer protrusion 13 on an outer peripheral surface of a cylindrical bobbin body 12. The bobbin 11, which is made, for example, of a thermoplastic resin, has the bobbin body 12 and a spacer protrusion 13 which are integrally molded. A direction in which the spacer protrusion protrudes (angle formed to the outer peripheral surface of the bobbin body) is set as appropriate in conformity to the structure (shape/direction of slit) of an applied coil.

Figure 2:
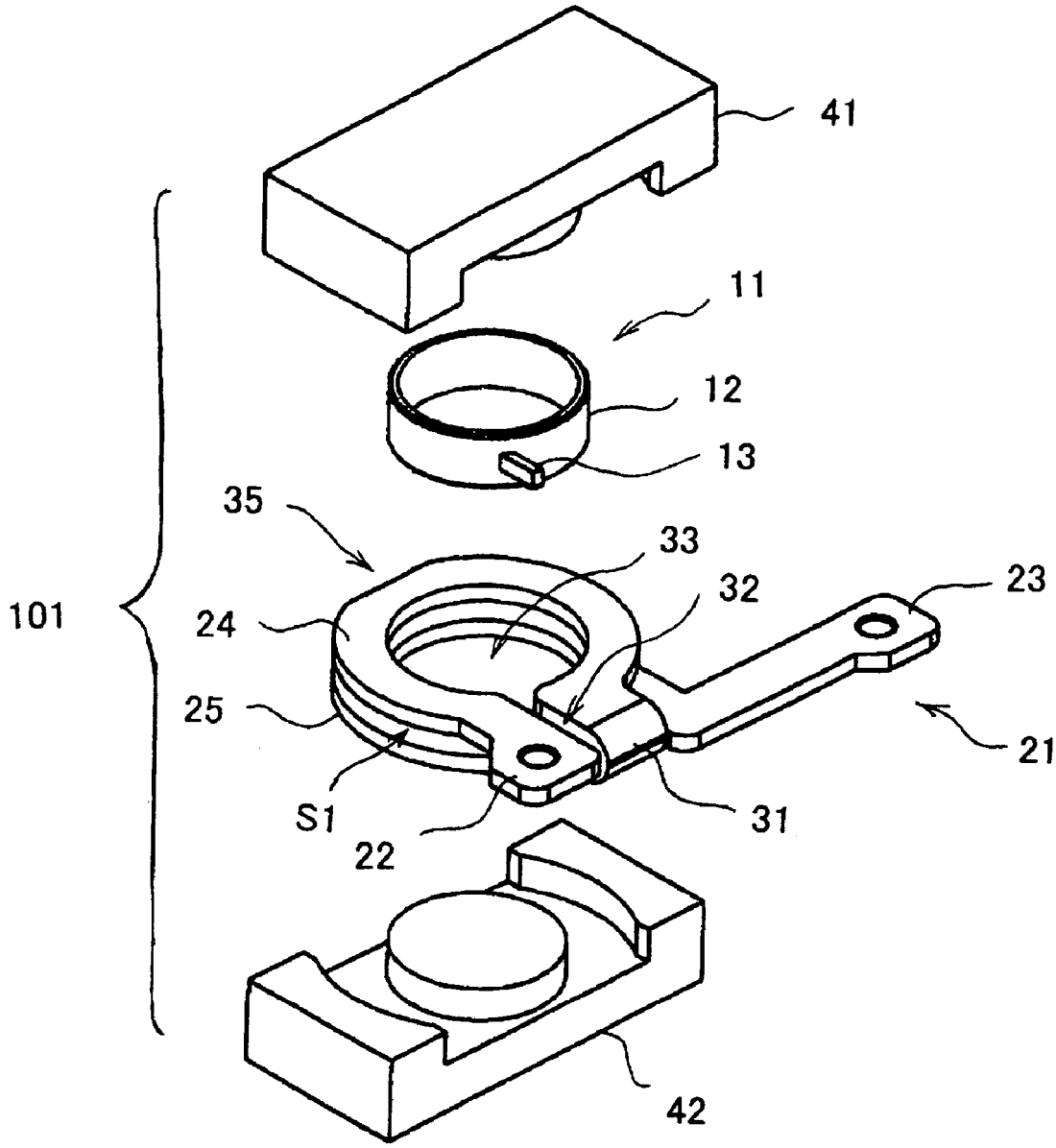
FIG. 2 An exploded perspective view illustrating a coil which employs the bobbin according to the first embodiment.

FIG. 2 is an exploded perspective view of the bobbin 11 for a coil, when it is mounted in a coil having a core. The bobbin 11 for a coil is mounted in a coil 101 which comprises a winding 21, and cores 41, 42 for establishing insulation between these winding 21 and cores 41, 42. The bobbin body 12 can be fitted into the winding 21, and the spacer protrusion 13, which substantially horizontally extends outward from the outer peripheral surface of the bobbin body 12, can be fitted between windings of the coil.

The winding 21 forms two winding sections 24, 25 which form a loop-shaped current path between input/output terminals 22, 23 arranged at both ends formed by stamping a sheet plate (copper plate), and a part (bend 31) between both winding sections is folded such that these winding sections 24, 25 overlap each other across a fixed spacing. The structure of the coil itself is such that a sheet plate is folded to form the winding, and a slit 32 (extending between an inner area 33 and an outer area of the winding) is formed in each winding section 24, 25 to divide the windings 24, 25 between the leading end and trailing end. On the other hand, the cores 41, 42, which are made of a ferromagnetic material, sandwich the winding 21 from above and below to form a magnetic flux path inside and around the winding 21.

The spacer protrusion 13 has a width dimension smaller than the width of the slit 32 such that it can be fitted in the slit 32 of the winding section 24, and has a thickness dimension equal to or slightly larger than the spacing between the winding 24 and winding 25. The spacer protrusion 13 is press fitted between winding sections 24, 25, and the bobbin body 12 is rotated in order that the spacer protrusion 13 can be arranged at a loop leading end 35 (between the winding sections on the opposite side of the bend 31), and will not readily shift in position (rotate) due to vibrations and the like received by the coil 101 after it has been arranged at that position.

Figure 3:
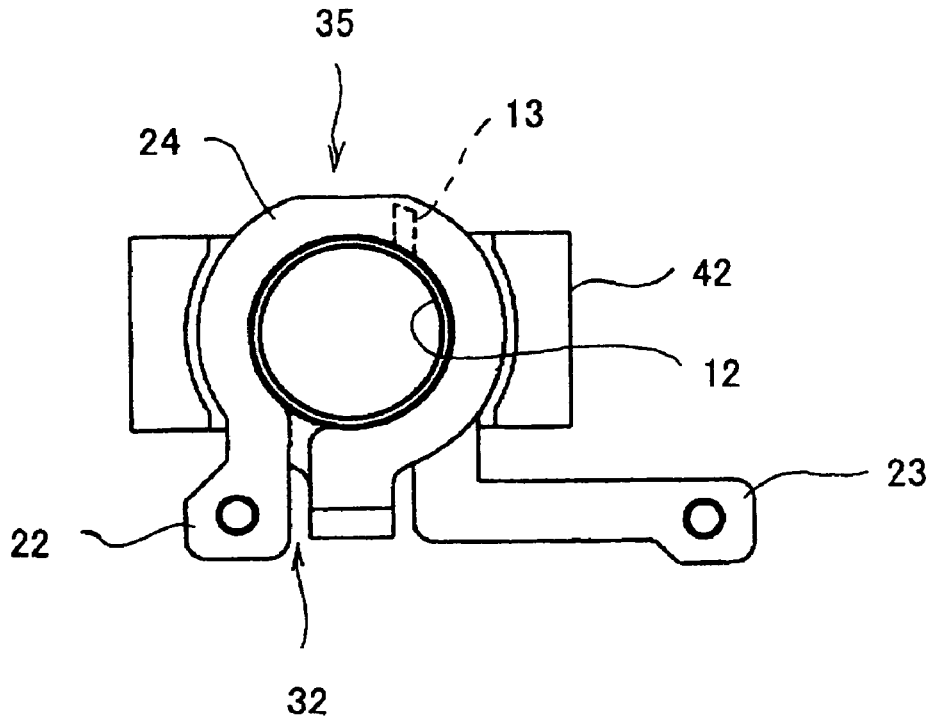
FIG. 3 A top plan view illustrating a mounted state of the bobbin according to the first embodiment.

For mounting the bobbin 11, the spacer protrusion 13 is registered to the slit 32 of the winding section 24, and the spacer protrusion 13 is dropped into the slit 32, while the bobbin body 12 is inserted into the inside 33 of the winding. Then, as the spacer protrusion 13 comes into contact with the top surface of the lower winding section 25, the bobbin body 12 is rotated to turn the spacer protrusion 13, thus placing the spacer protrusion 13 at the loop leading end 35, as illustrated in FIG. 3. By thus arranging the spacer protrusion 13 at the loop leading end 35, the winding sections 24, 25 can be prevented from coming into contact with each other more reliably than before.

Figure 4:
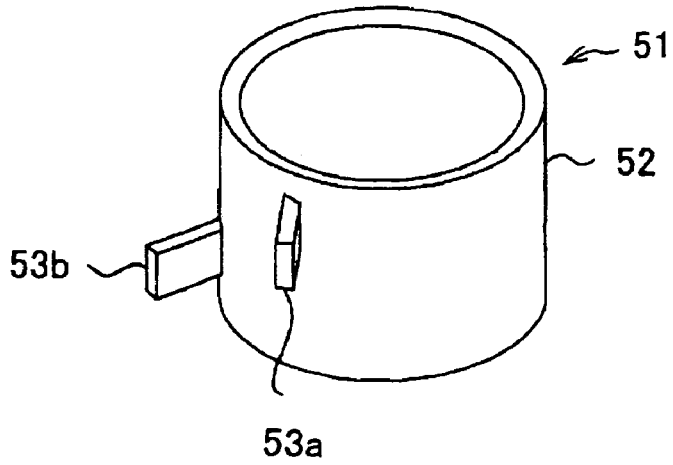
FIG. 4 A perspective view illustrating an exemplary modification to the bobbin according to the first embodiment.
Figure 5:
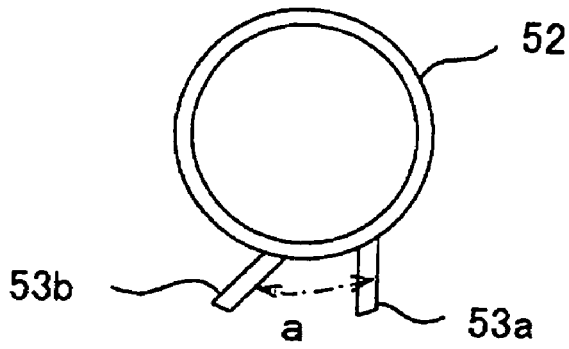
FIG. 5 A top plan view of the bobbin illustrated in FIG. 4.

FIGS. 4 and 5 illustrate an exemplary configuration of the bobbin which can be applied to a 3-turn coil. As illustrated in these figures, since the 3-turn coil includes two spaces between winding sections, this bobbin 51 is provided with two spacer protrusions 53*a*, 53*b* on a bobbin body 52 in correspondence thereto.

The respective spacer protrusions 53*a*, 53*b* are disposed with their positions shifted in the rotating direction in registration to the positions of the slits in the winding sections, such that bobbin 51 can be fitted in the winding. Specifically, the upper spacer protrusion 53*a* is spaced apart from the lower spacer protrusion 53*b* by a distance (angle) set to a in conformity to the distance (angle) a between a slit 62*a* of the uppermost winding section 64 and a slit 62*b* of the next (underlying) winding section 65 of the 3-turn coil 60 (see FIGS. 6, 7).

For mounting the bobbin 51 in the coil 60, the lower spacer protrusion 53*b* is first dropped into the slit 62*a* of the uppermost winding section 64, and turned to the position of the slit 62*b* of the lower winding section 65. Consequently, the upper spacer protrusion 53*a* comes to the position of the slit 62*a* of the uppermost winding section 64, so that the lower spacer protrusion 53*b* is dropped into the slit 62*b* of the lower winding section 65, and simultaneously, the upper spacer protrusion 53*a* is dropped into the slit 62*a* of the uppermost winding section 64. Then, the bobbin body 52 is further turned to place both spacer protrusions 53*a*, 53*b* at the loop leading end 75. In this way, the spacer protrusions 53*a*, 53*b* can be interposed in winding gaps S1, S2, respectively.

Figure 6:
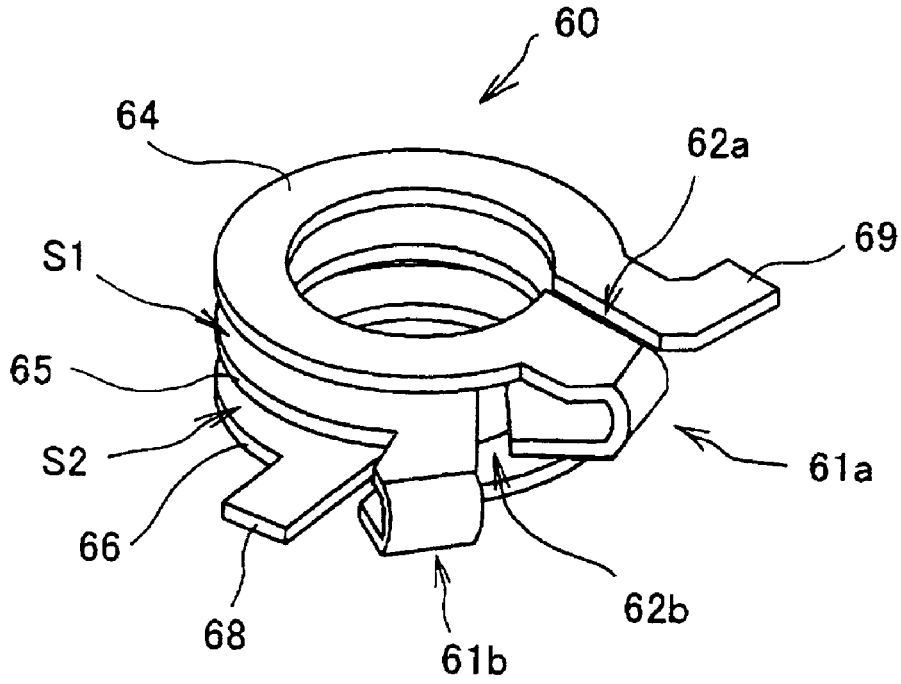
FIG. 6 A perspective view illustrating a coil which employs the bobbin of FIG. 4.
Figure 7:
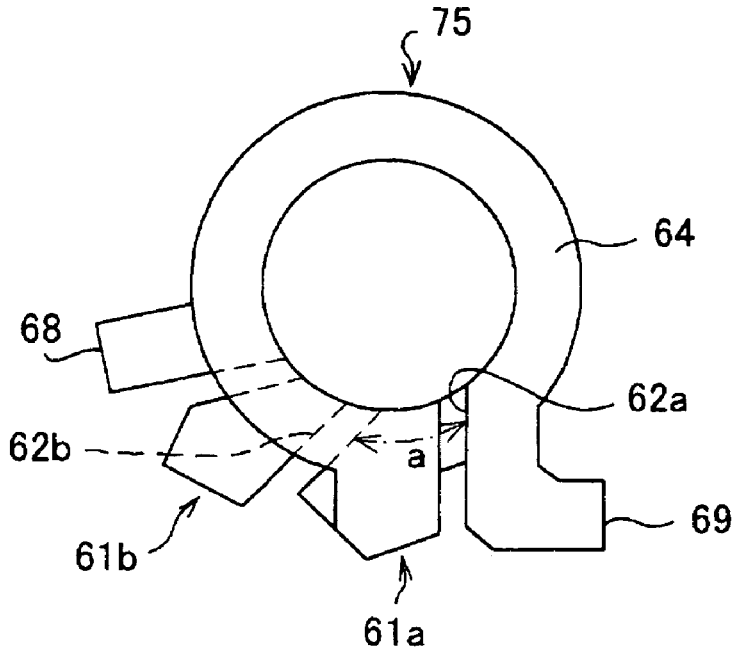
FIG. 7 A top plan view illustrating the coil of FIG. 6.

When the coil has slits which are not radially formed as in examples illustrated in FIGS. 6 and 7, for example, when a lower slit (62*b*) is formed in parallel with an uppermost slit (62*a*), the spacer protrusion may be reduced in width dimension as compared with the slit width to provide a sufficient margin (play) which can absorb an angular shift between the slit and spacer protrusion, when the bobbin body is rotated to bring the spacer protrusion to the position of the lower slit. In this way, the spacer protrusion 53*b* can be placed in the lower winding gap S2.

Figure 8:
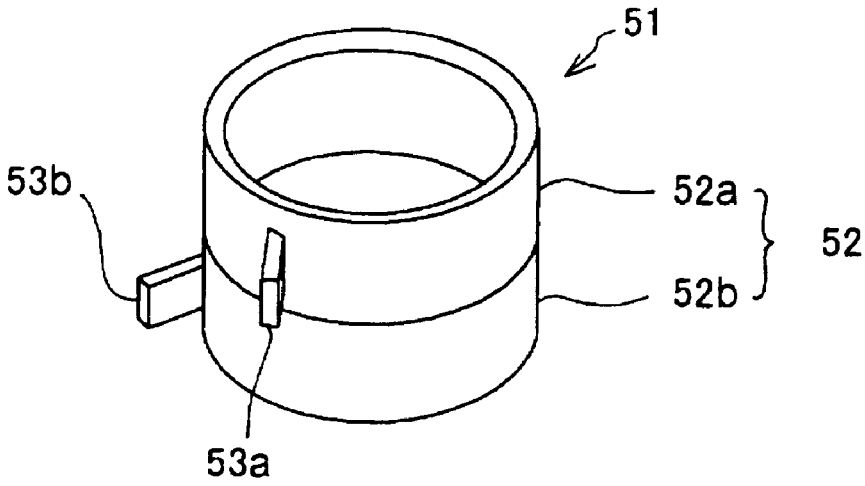
FIG. 8 A perspective view illustrating another exemplary modification to the bobbin according to the first embodiment.
Figure 9:
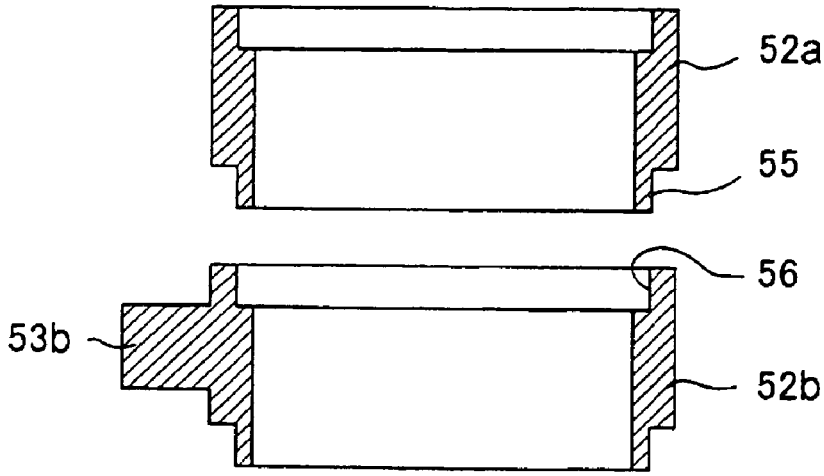
FIG. 9 A cross-sectional view illustrating the bobbin of FIG. 8 in an exploded form.

In this example, the bobbin body 52 is formed in one piece (as a single part), but the bobbin body 52 can also be composed of two cylindrical members 52*a*, 52*b* into which the bobbin body 52 is horizontally divided, for example, at a height position of substantially one-half of the overall height, as illustrated in FIGS. 8 and 9. In this event, the upper cylindrical member 52*a* is formed with a small diameter portion 55, which is reduced in diameter, on the lower end thereof, while the lower cylindrical member 52*b* is formed with a larger diameter portion 56, for receiving the small diameter portion 55 on the upper end thereof, such that both cylindrical members 52*a*, 52*b* can be connected one on the other. Also, the respective cylindrical members 52*a*, 52*b* are provided with spacer protrusions 53*a*, 53*b* on the outer peripheral surfaces. In mounting, the respective cylindrical members 52*a*, 52*b* can be individually fitted into the winding, and the respective spacer protrusions 53*a*, 53*b* can be placed in the windings S1, S2, respectively.

Figure 10:
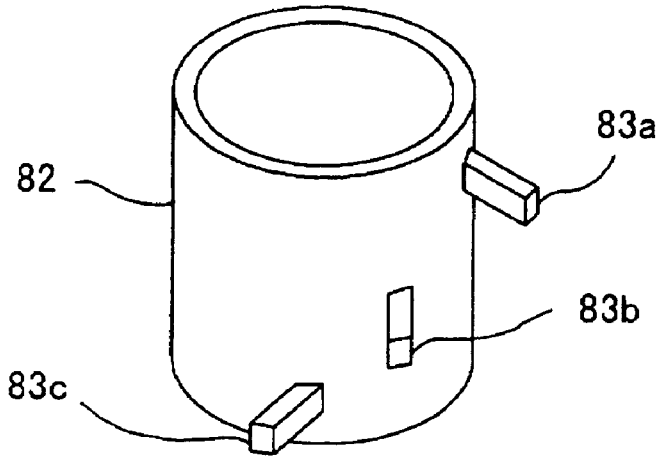
FIG. 10 A perspective view illustrating a further exemplary modification to the bobbin according to the first embodiment.

Further, for a 4-turn coil, a bobbin body 82 may be formed with three spacer protrusions 83*a*, 83*b*, 83*c* fitted between respective winding sections, as illustrated in FIG. 10, and a bobbin may also be created for a coil having five turns or more in a similar manner. In these events, a plurality of cylindrical members may be connected to make up a bobbin body, in a manner similar to the example illustrated in FIGS. 8 and 9.

Embodiment 2

FIGS. 1A and 1B illustrate a bobbin for a coil according to a second embodiment of the present invention. The bobbin illustrated in these figures comprises a horizontally extending flange 93 on the upper end of a cylindrical bobbin body 91 having a spacer protrusion 92 similar to the first embodiment, and stopper protrusions 94 protruding further upward from the top surface of the flange at four corners of the flange 93. This bobbin for a coil is configured such that the spacer protrusion 92 interposes in the winding spacing S1 when it is mounted in the coil 101 illustrated in FIG. 2 instead of the bobbin 11. The stopper protrusions 94 abut to side edges of the core 41 when the bobbin is mounted in the winding and the core is covered. By providing such stopper protrusions 94, the bobbin can also be prevented from rotational shifts.

Embodiment 3

Figure 12A:
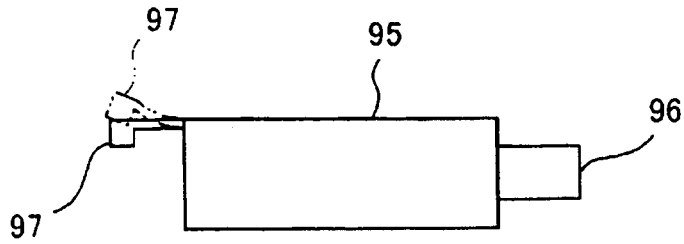
FIG. 12A A side view illustrating a bobbin for a coil according to a third embodiment of the present invention.
Figure 12B:
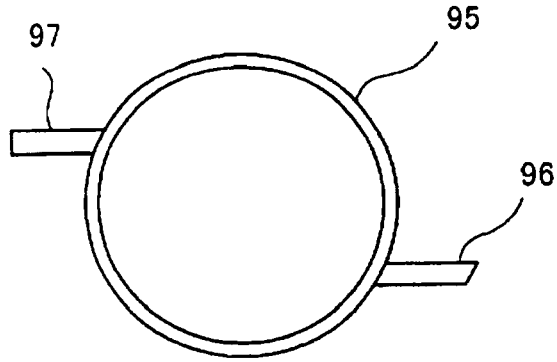
FIG. 12B A top plan view illustrating the bobbin for a coil according to the third embodiment of the present invention.

Further, FIGS. 12A and 12B illustrate a bobbin for a coil according to a third embodiment of the present invention. As illustrated in these figures, this bobbin comprises a stopper piece 97 which fits into the slit 32 (see FIG. 2) of the winding section, as means for preventing the bobbin from rotational shifts.

The stopper piece 97 is disposed substantially on the opposite side of the spacer protrusion 96, as viewed on a top plan view (FIG. 12B), such that it is brought to the position of the slit 32 of the winding section 24 when a spacer protrusion 96 is rotated to be positioned at the loop leading end 35. Also, the stopper piece 97 is flexible, and is provided at the upper end of the bobbin body 95. Therefore, when the spacer protrusion 96 is dropped into the slit 32, the stopper piece 97 distorts upward (shown by two-dot chain lines in FIG. 12A) to allow the bobbin body 95 to be inserted into the inside 33 of the winding. On the other hand, as the bobbin is rotated to position the spacer protrusion 96 at the loop leading end 35, the stopper piece 97 drops into the slit 32 and returns to the original horizontal state (indicated by solid lines in FIG. 12A). In this way, the stopper piece 97 fits into the slit 32, and can prevent the bobbin from rotating.

Embodiment 4

Figure 13:
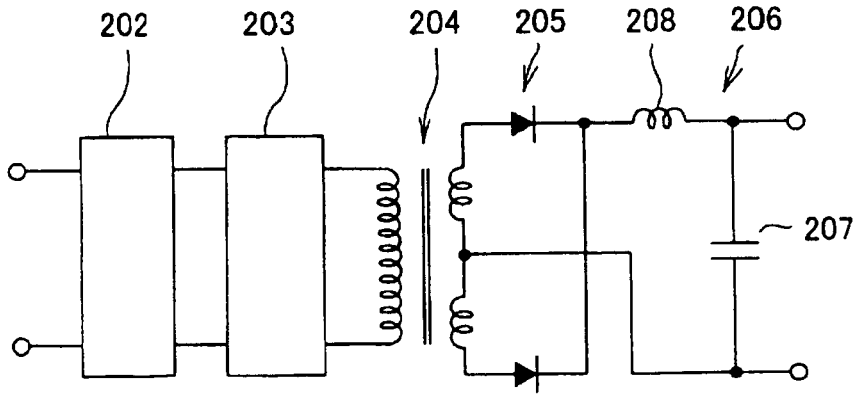
FIG. 13 A circuit diagram illustrating an exemplary DC-DC converter according to the present invention.
Figure 14:
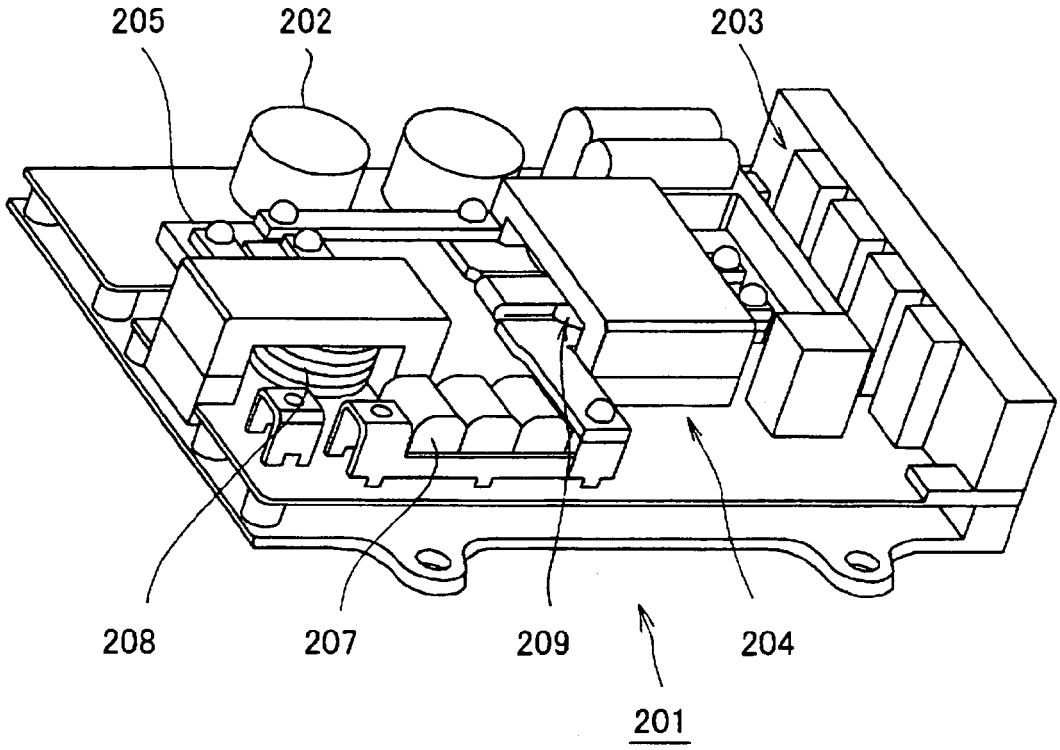
FIG. 14 A general perspective view illustrating the exemplary DC-DC converter according to the present invention.
Figure 15:
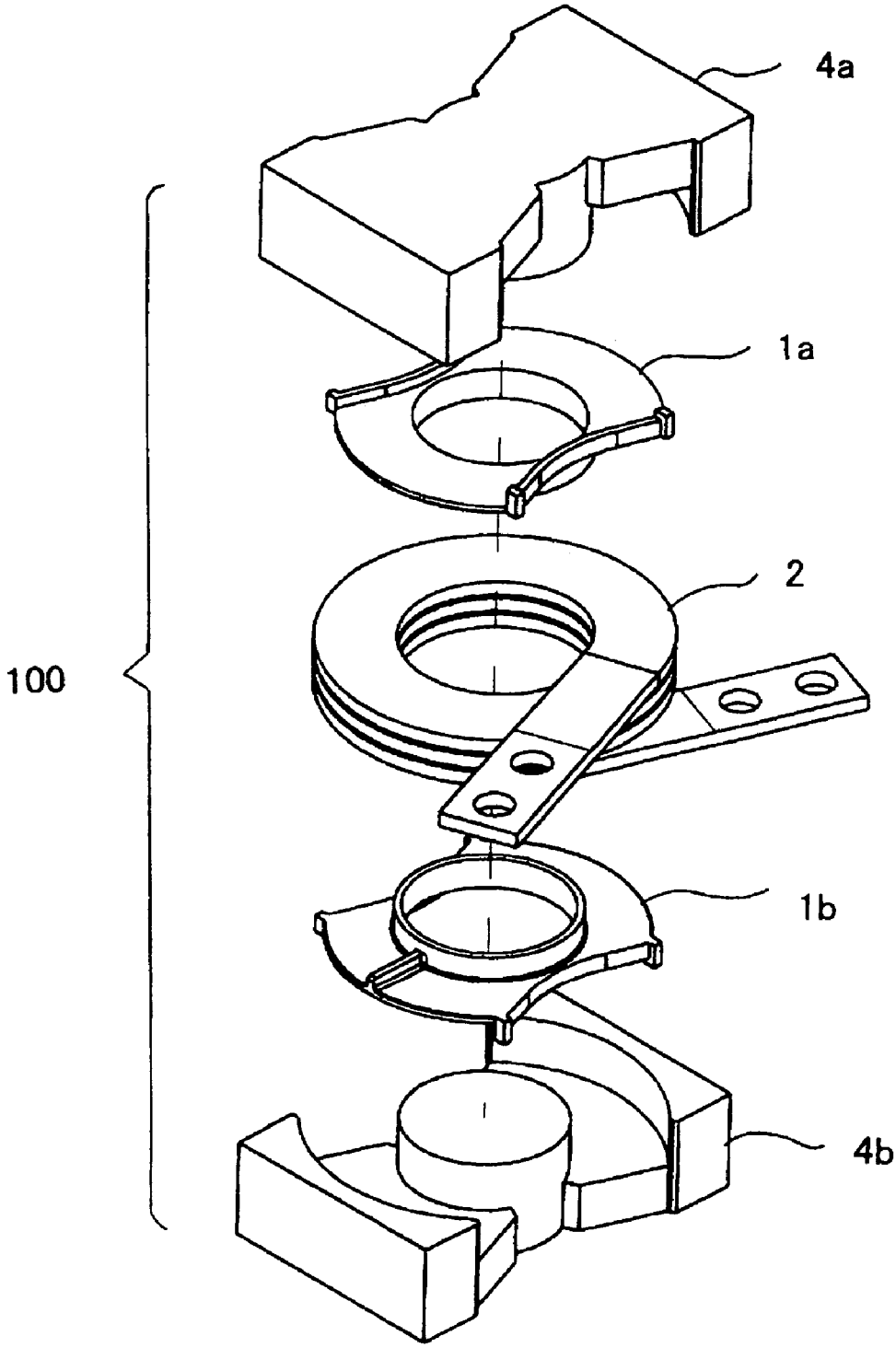
FIG. 15 An exploded perspective view illustrating an exemplary conventional coil.

The bobbins according to the foregoing embodiments can be used, for example, in a transformer and a coil in a DC-DC converter. FIGS. 13 and 14 are a circuit diagram and a general perspective view, respectively, of a DC-DC converter according to one embodiment of the present invention.

As illustrated in these figures, this DC-DC converter 201 comprises an input smoothing circuit 202 connected to a DC power supply (not shown), which is, for example, a battery for a car, for smoothing its current; an inverter circuit 203 for converting DC power inputted from the input smoothing circuit 202 to AC power; a transformer 204 for transforming an output voltage of the inverter circuit 203; a full wave rectifier circuit module 205 for rectifying the output of the transformer 204; and an output smoothing circuit 206 for smoothing an output voltage of the full wave rectifier circuit module 205. The output smoothing circuit 206 comprises a smoothing capacitor 207 and a chalk coil 208, and further comprises a controller (not shown) for controlling the inverter circuit 203, a current sensor (not show), and the like. Then, the bobbin according to the aforementioned embodiment is mounted in at least one winding of a primary and a secondary winding 209 of the transformer 204, and in the chalk coil 208. The DC-DC converter illustrated in these figures is illustrated merely as one example, and other circuit configurations, and other layouts for the respective components can be employed as well.

While the embodiments of the present invention have been described with reference to the drawings, it is apparent to those skilled in the art that the present invention is not limited to this, but a variety of modifications can be made within the scope described in claims.

For example, while the foregoing embodiments have illustrated a cored coil having a core, the coil according to the present invention, and a coil to which the bobbin according to the present invention is applied may be air-core coils which do not have a core. Also, the bobbin body, spacer protrusions (protrusion parts), and stopper means for preventing the bobbin from rotational shifts can take a variety of structures in accordance with the shapes and the like of windings and cores, and are not limited to the shapes and structures in the foregoing embodiments. Also, the number of turns (number of windings) of the coil is not limited to two turns or three turns, but can also be four turns or more.

Also, the coil of the present invention, and a coil which uses the bobbin of the present invention can form a variety of circuits as inductance elements, and can form part of a variety of devices, for example, a switching power supply unit, a noise filter, a transformer, a DC-DC converter, an inverter and the like.

DESCRIPTION OF REFERENCE NUMERALS

11, 51 Bobbins for Coil
12, 52, 82, 91, 95 Bobbin Bodies
13, 53*a*, 53*b*, 83*a*, 83*b*, 83*c*, 92, 96 Spacer Protrusions
21, 60 Windings
22, 23, 68, 69 Input/Output Terminals
24, 25, 65, 66 Winding Sections
31, 61*a*, 61*b* Bends
32, 62*a*, 62*b* Slits
35, 75 Loop Leading Ends
41, 42 Cores
93 Flange
94 Stopper Protrusion
97 Stopper Piece
101 Coil
201 DC-DC Converter
202 Input Smoothing Circuit
203 Inverter Circuit
204 Transformer
205 Full Wave Rectifier Circuit Module
206 Output Smoothing Circuit
207 Smoothing Filter
208 Chalk Coil
209 Winding of Transformer

The invention claimed is:

1. A bobbin for a coil having a slit with a predetermined width comprising:

a bobbin body formed of an insulating material, and capable of fitting into the inside of the windings of the coil; and a protrusion formed of an insulating material, extending outward from an outer peripheral surface of said bobbin body, and capable of interposing between the windings, wherein said protrusion has a width dimension smaller than the width of the slit so as to be fitted into the slit and interposed between the windings.

2. The bobbin for a coil according to claim 1, wherein:

said bobbin comprises two or more of said protrusions, and said two or more protrusions are spaced apart from one another at intervals of a predefined spacing corresponding to a pitch of the windings with respect to a lengthwise direction of said bobbin body.

3. The bobbin for a coil according to claim 1, further comprising:

stopper means protruding from said bobbin body, and abutting to the windings or core when said bobbin is mounted in the coil to prevent said bobbin from rotating.

4. The bobbin for a coil according to claim 1, wherein said stopper means comprises:

a flange extending outward from the outer peripheral surface of said bobbin body at an end of said bobbin body in a lengthwise direction; and at least one stopper protrusion protruding from an edge of said flange in a direction opposite to a direction in which said bobbin body extends for engagement with a core.

5. A coil comprising:

windings having a slit with a predetermined width; and a bobbin including a bobbin body formed of an insulating material and fitted into the inside of said windings, and a protrusion formed of an insulating material, having a width dimension smaller than the width of the slit so as to be fitted into the slit and interposed between the windings, extending outward from an outer peripheral surface of said bobbin body and interposed between said windings.

6. The coil according to claim 5, wherein:

said bobbin comprises two or more of said protrusions, and said two or more protrusions are spaced apart from one another at intervals of a predefined spacing corresponding to a pitch of the windings with respect to a lengthwise direction of said bobbin body.

7. The coil according to claim 6, wherein said protrusion has a thickness dimension of a size equal to or larger than a spacing between said windings.

8. The coil according to claim 5, further comprising:

stopper means protruding from said bobbin body, and abutting to the windings to prevent said bobbin from rotating.

9. The coil according to claim 5, wherein said protrusion has a thickness dimension of a size equal to or larger than a spacing between said windings.

10. The coil according to claim 5, further comprising a core, wherein said bobbin includes stopper means protruding from said bobbin body, and abutting to the core to prevent said bobbin from rotating.

11. The coil according to claim 8, wherein:

said stopper means comprises a stopper piece configured to protrude outward from the outer peripheral surface of said bobbin body substantially on the opposite side of said protrusion, and fitted in the slit.

12. The coil according to claim 10, wherein said stopper means comprises:

a flange extending outward from the outer peripheral surface of said bobbin body at an end of said bobbin body in a lengthwise direction; and at least one stopper protrusion protruding from an edge of said flange in a direction opposite to a direction in which said bobbin body extends for engagement with a core.

13. The coil according to claim 5, wherein:

said windings is formed of sheet plate windings.

14. The coil according to claim 13, wherein:

said coil is a folded coil having a bend, and said slit is formed at the bend.

15. The transformer comprising:

a primary winding;

a secondary winding;

a bobbin provided in at least one of the primary winding and the secondary winding;

wherein said at least one winding of the primary winding and the secondary winding has a slit with a predetermined width; and said bobbin includes a bobbin body formed of an insulating material and fitted into the inside of the winding, and a protrusion formed of an insulating material, having a width dimension smaller than the width of the slit so as to be fitted into the slit and interposed between the windings, extending outward from an outer peripheral surface of said bobbin body and interposed between the windings.

16. The transformer according to claim 15, wherein:

said at least one of the primary winding and the secondary winding is formed of sheet plate windings.

17. The transformer according to claim 16, wherein:

said at least one of the primary winding and the secondary winding is formed of a folded coil having a bend, and said slit is formed at the bend.

18. The DC-DC converter comprising:

a transformer, the transformer including:

a primary winding;

a secondary winding; and a bobbin provided in at least one of the primary winding and the secondary winding;

wherein said at least one of the primary winding and the secondary winding has a slit with a predetermined width; and said bobbin, includes a bobbin body formed of an insulating material and fitted into the inside of the winding, and a protrusion formed of an insulating material, having a width dimension smaller than the width of the slit so as to be fitted into the slit and interposed between the windings, extending outward from an outer peripheral surface of said bobbin body and interposed between the windings.

19. The DC-DC converter according to claim 18, wherein:

said at least one of the primary winding and the secondary winding is formed of sheet plate windings.

20. The DC-DC converter according to claim 19, wherein:

said at least one of the primary winding and the secondary winding is formed of a folded coil having a bend, and said slit is formed at the bend.

* * * * *

UNITED STATES PATENT AND TRADEMARK OFFICE

CERTIFICATE OF CORRECTION

Figure 11A:
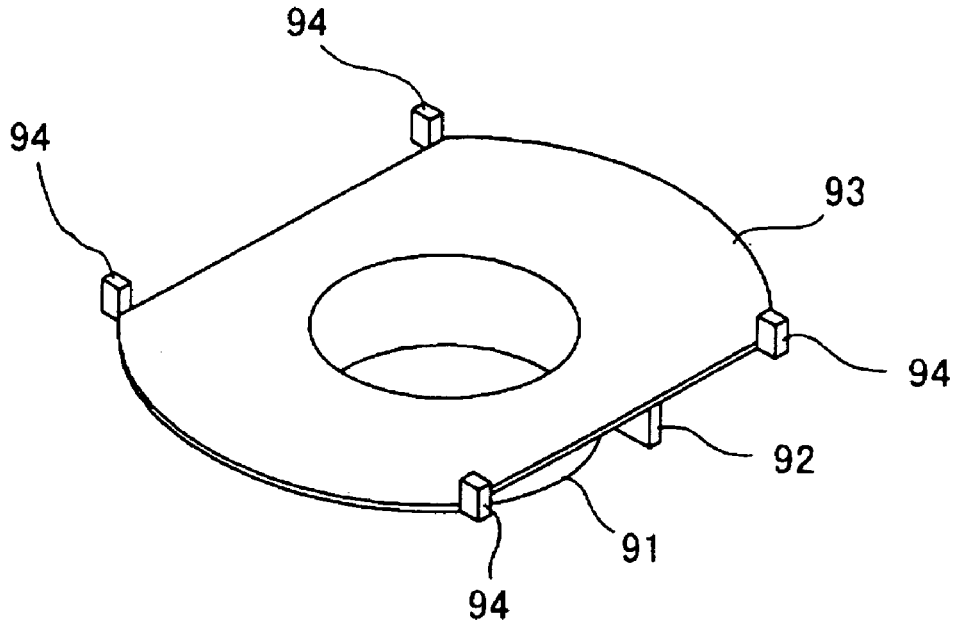
FIG. 11A A perspective view of a surface side illustrating a bobbin for a coil according to a second embodiment of the present invention.
Figure 11B:
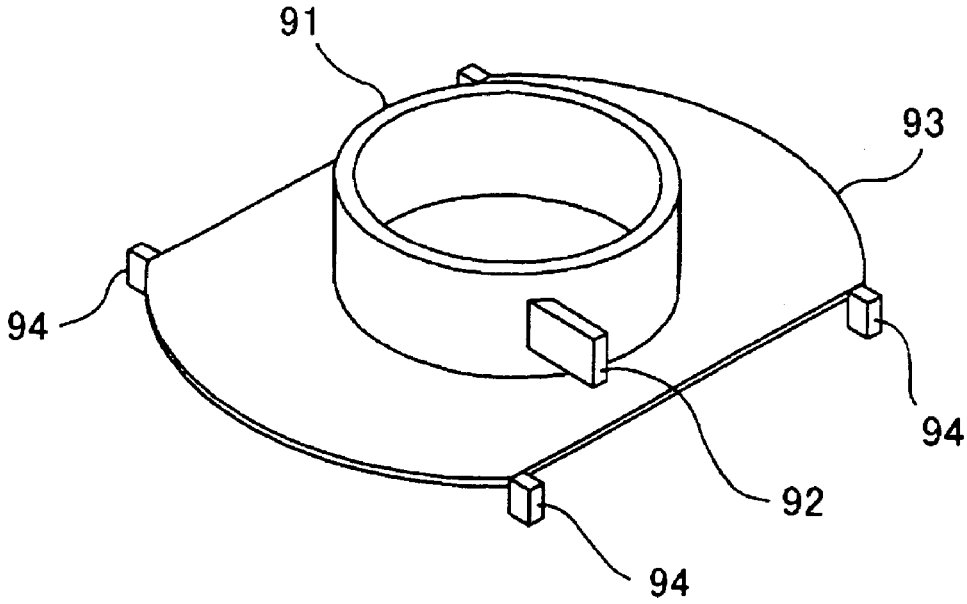
FIG. 11B A perspective view of a back side illustrating the bobbin for a coil according to the second embodiment of the present invention.

PATENT NO. : 7,408,436 B2
APPLICATION NO. : 10/587742
DATED : August 5, 2008
INVENTOR(S) : Akira Ikezawa It is certified that error appears in the above-identified patent and that said Letters Patent is hereby corrected as shown below:

Col. 6, line 35, change "FIGS. 1A and 1B" to --FIGS. 11A and 11B--.

Col. 9, line 30, change "The" to --A--.

Col. 10, line 14, change "The" to --A--.

Signed and Sealed this

Eighteenth Day of November, 2008

JON W. DUDAS
*Director of the United States Patent and Trademark Office*